US009328708B2

(12) United States Patent
Boecking

(10) Patent No.: US 9,328,708 B2
(45) Date of Patent: May 3, 2016

(54) FUEL INJECTION SYSTEM OF AN INTERNAL COMBUSTION ENGINE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 835 days.

(21) Appl. No.: 13/577,973

(22) PCT Filed: Feb. 3, 2011

(86) PCT No.: PCT/EP2011/051594

§ 371 (c)(1),
(2), (4) Date: Aug. 9, 2012

(87) PCT Pub. No.: WO2011/110389

PCT Pub. Date: Sep. 15, 2011

(65) Prior Publication Data

US 2012/0325173 A1 Dec. 27, 2012

(30) Foreign Application Priority Data

Mar. 12, 2010 (DE) ..... 10 2010 002 801

(51) Int. Cl.
*F02M 57/02* (2006.01)
*F02M 59/42* (2006.01)
(Continued)

(52) U.S. Cl.
CPC ..... *F02M 59/42* (2013.01); *F02D 33/006* (2013.01); *F02D 41/062* (2013.01);
(Continued)

(58) Field of Classification Search
CPC ..... F02M 37/04; F02M 37/041; F02M 37/06; F02M 63/0225; F02M 63/027; F02M 69/38; F02M 63/0245; F02M 63/025; F02M 63/0265; F02M 63/0275; F02M 59/447; F02M 59/42; F02M 59/464; F02M 59/466; F02M 63/024; F02D 41/06; F02D 41/062; F02D 41/064; F02D 41/3845; F02D 41/3082; F02D 33/006; F02D 2041/1422
USPC ..... 123/446, 447, 495, 497, 179.16, 179.17
See application file for complete search history.

(56) References Cited

U.S. PATENT DOCUMENTS 4,572,136 A * 2/1986 Takeuchi et al. ..... 123/447
4,667,638 A * 5/1987 Igashira ..... F02M 47/02 123/179.17

(Continued)

FOREIGN PATENT DOCUMENTS

DE 19848831 4/1999
DE 10341789 4/2005

(Continued)

OTHER PUBLICATIONS

PCT/EP2011/051594 International Search Report dated Apr. 27, 2011 (Translation and Original, 6 pages).

*Primary Examiner* — Thomas Moulis
(74) *Attorney, Agent, or Firm* — Michael Best & Friedrich LLP

(57) ABSTRACT

The invention relates to a fuel injection system of an internal combustion engine, comprising a presupply pump (1) and a downstream high-pressure pump (7), which is connected to a high-pressure accumulator (9) and wherein the high pressure accumulator (9) is operatively connected to at least one fuel injector (10). According to the invention, a fuel injection system is provided and a method for operating such a fuel system is described which avoids the disadvantage of a slow pressure build-up in the high-pressure accumulator (9) and rather allows a rapid start of the internal combustion engine. This is achieved in that the presupply pump (1) is designed to generate a delivery pressure by which a fuel injection by means of the fuel injector (10) is effected, at least in a defined operating state of the internal combustion engine. At the delivery pressure generated by the presupply pump (1), the fuel injector is prompted to open by a control device. A corresponding method for operating the fuel injection system provides for the presupply pump (1) to be operated in a starting operating mode until the internal combustion engine has been started, and after the internal combustion engine has been started to be operated in a presupply operating mode.

13 Claims, 2 Drawing Sheets

(51) Int. Cl.

| | |
|---|---|
| ***F02M 69/34*** | (2006.01) |
| ***F02M 69/42*** | (2006.01) |
| ***F02D 33/00*** | (2006.01) |
| ***F02D 41/06*** | (2006.01) |
| ***F02D 41/38*** | (2006.01) |
| ***F02M 59/12*** | (2006.01) |
| ***F02M 63/02*** | (2006.01) |
| ***F02M 59/02*** | (2006.01) |

(52) U.S. Cl.

CPC ..... *F02D 41/3854* (2013.01); *F02M 59/02* (2013.01); *F02M 59/12* (2013.01); *F02M 63/027* (2013.01); *F02M 69/34* (2013.01); *F02M 69/42* (2013.01)

(56) References Cited

U.S. PATENT DOCUMENTS 4,800,859 A * 1/1989 Sagisaka ..... F02D 41/3082 123/459
4,841,936 A * 6/1989 Takahashi ..... 123/447
4,884,545 A * 12/1989 Mathis ..... F02D 41/3845 123/446
5,313,923 A * 5/1994 Takeuchi ..... F02D 41/3082 123/198 DB
5,572,974 A * 11/1996 Wakeman ..... F02M 51/00 123/198 D
5,598,817 A * 2/1997 Igarashi et al. ..... 123/179.17
5,622,152 A * 4/1997 Ishida ..... F02M 45/02 123/446
5,727,515 A * 3/1998 Biester ..... F02D 41/221 123/198 D
5,794,586 A 8/1998 Oda et al.
5,878,718 A * 3/1999 Rembold ..... F02D 33/006 123/198 D
5,884,597 A * 3/1999 Hiraku ..... F02M 59/04 123/179.17
6,065,436 A * 5/2000 Koga et al. ..... 123/179.17
6,367,454 B1 4/2002 Rembold et al.
6,467,461 B1 * 10/2002 Becker ..... F02D 41/061 123/179.17
6,748,924 B2 * 6/2004 Yu ..... 123/458
6,761,151 B2 * 7/2004 Kojima ..... 123/458
6,769,414 B2 * 8/2004 Rembold ..... F02D 33/006 123/179.17
6,817,343 B1 11/2004 Greco et al.
6,889,656 B1 5/2005 Rembold et al.
6,923,159 B2 * 8/2005 Sakumoto ..... F02D 41/3082 123/179.17
7,028,667 B2 * 4/2006 Hori ..... 123/446
7,089,914 B2 * 8/2006 Joos ..... F02D 41/065 123/179.17
7,201,128 B2 * 4/2007 Freisinger ..... F02M 55/025 123/179.17
7,207,319 B2 * 4/2007 Utsumi ..... F02D 41/22 123/446
7,261,087 B2 * 8/2007 Ricco ..... F02D 41/3845 123/446
7,281,520 B2 * 10/2007 Klenk ..... F02M 37/18 123/446
7,448,361 B1 * 11/2008 Pursifull et al. ..... 123/456
7,822,534 B2 * 10/2010 Matsubara ..... F01N 3/0807 123/198 DB
8,151,767 B2 * 4/2012 Pursifull ..... F02D 33/006 123/179.17
8,166,943 B2 * 5/2012 Chamarthi ..... F02D 41/3845 123/179.17
2005/0188958 A1 * 9/2005 Klenk et al. ..... 123/458
2009/0095259 A1 * 4/2009 Pursifull et al. ..... 123/457

FOREIGN PATENT DOCUMENTS

EP 1544447 6/2005
JP 1077892 * 3/1998 ..... F02D 41/22
JP 10288107 10/1998
JP 11210532 * 8/1999 ..... F02D 41/22
JP 2002061529 2/2002
JP 2008121563 5/2008

* cited by examiner

FUEL INJECTION SYSTEM OF AN INTERNAL COMBUSTION ENGINE

TECHNICAL FIELD

The invention relates to a fuel injection system of an internal combustion engine, comprising a pre-supply pump and a downstream high-pressure pump which is connected to a high-pressure accumulator, and wherein the high-pressure accumulator is operatively connected to at least one fuel injector.

THE RELATED ART

A fuel injection system of this type is known from DE 10 2004 018 843 A1. This fuel injection system is designed as a common rail injection system. With a common rail injection system the pressure in the high-pressure accumulator (rail) can fall so far, after the engine has been stopped, that insufficiently high fuel pressure is available for restarting the engine, which pressure would be needed to inject fuel by means of a fuel injector into the associated combustion chamber of the internal combustion engine. In order to enable the engine to be started nevertheless, the fuel injection system includes an electronic control module having a priming algorithm. The priming algorithm has the effect that an electrically driven pump is activated when the high-pressure accumulator is in an unprimed state. The electronic control module is connected to at least one sensor which can determine the state of the fuel injection system. A disadvantage of this system is that a not insignificant time period, needed to build up the necessary fuel pressure, passes in any case prior to starting the engine. In addition, the constructional cost of the system is high.

It is the object of the invention to provide a fuel injection system and to specify a method for operating such a fuel system which avoids the known disadvantages and allows a rapid start of the internal combustion engine. This is to be achieved at low constructional cost.

DISCLOSURE OF THE INVENTION

This object is achieved in that the pre-supply pump is designed to generate a delivery pressure by which a fuel injection by means of the fuel injector is effected, at least in a defined operating state of the internal combustion engine. In this case the defined operating state is, in particular, the starting process of the internal combustion engine. A corresponding method for operating the fuel injection system provides for the pre-supply pump to be operated in a starting operating mode until the internal combustion engine has been started, and to be operated in a pre-supply operating mode after the internal combustion engine has been started. A fundamental concept of the present invention is that no additional pumps or control modules which are utilized solely for starting the internal combustion engine should be used, but that components needed for the normal operation of the internal combustion engine should be designed such that they allow a rapid start of the internal combustion engine. Here, the present invention starts from recognition of the fact that, to start the internal combustion engine successfully, it is sufficient if a fuel pressure corresponding to the minimum opening pressure of the fuel injector is available in the starting phase. It should be taken into account here that fuel injectors commonly used today for corresponding fuel injection systems do not have a fixed opening pressure; rather, the opening and closing of the fuel injector is triggered by a control device which also manages the whole system. The minimum opening pressure therefore describes the delivery pressure which, on the one hand, can be provided with the pre-supply pump but, on the other hand, must be sufficiently high that fuel can be injected into the working chamber of the internal combustion engine against the pressure of the combustion air compressed therein. To sum up, when such a fuel pressure is reached fuel can be reliably injected by the fuel injector into the corresponding working chamber of the internal combustion engine and the internal combustion engine can be started.

In a development of the invention, the pre-supply pump is designed so that it generates a pre-pressure of approximately 80-120 bar. Because this pressure must be generated for only a short time, it is not necessary to design the pre-supply pump so that it can generate such a delivery pressure continuously and for a long duration. Rather, it is entirely sufficient to design the starting operating mode as an overload operating mode which is to be provided for only a short time.

In a further configuration of the invention, the pre-supply pump is a gear pump. Especially if this gear pump is electrically operated, as provided in a further configuration, such a starting operating mode can be implemented simply in that the pre-supply pump is operated at higher electrical power. After the internal combustion engine has been started the pre-supply pump is then operated, in a further configuration of the invention, in a pre-supply operating mode, in which the delivery pressure is up to 8 bar. Such an approximately fifteen-fold overload can be implemented for a short time with the electrically operated gear pump described without disadvantages regarding the durability of a gear pump operated in such a way. Self-evidently, other suitable pre-supply pumps may also be used within the context of the invention.

In a development of the invention, a high-pressure pump working chamber of the high-pressure pump is connected to a suction valve and to a nonreturn valve. In this case the suction valve is connected via a metering unit to the pre-supply pump, while the nonreturn valve is connected directly to the high-pressure accumulator. This configuration makes it possible to charge the high-pressure accumulator with the pre-supply pump while in effect bypassing the high-pressure pump. In this case it is immaterial how the high-pressure pump is designed in terms of construction. However, because the high-pressure pump is always driven mechanically, for example by the crankshaft or the camshaft of the internal combustion engine, the high-pressure pump is operated at only a low starting speed during starting of the internal combustion engine. At such a low starting speed, however, the pressure losses occurring, for example, via the bearings of the drive shaft of the high-pressure pump, are also low. Here it is the case that, in normal operation of the high-pressure pump, a small quantity of fuel is deliberately discharged through the bearings in order to ensure lubrication of the bearings and/or venting of the high-pressure pump.

Further advantageous configurations of the invention are apparent from the description of the drawing, in which an exemplary embodiment of the invention represented in the figures is described in more detail.

Figure 1:
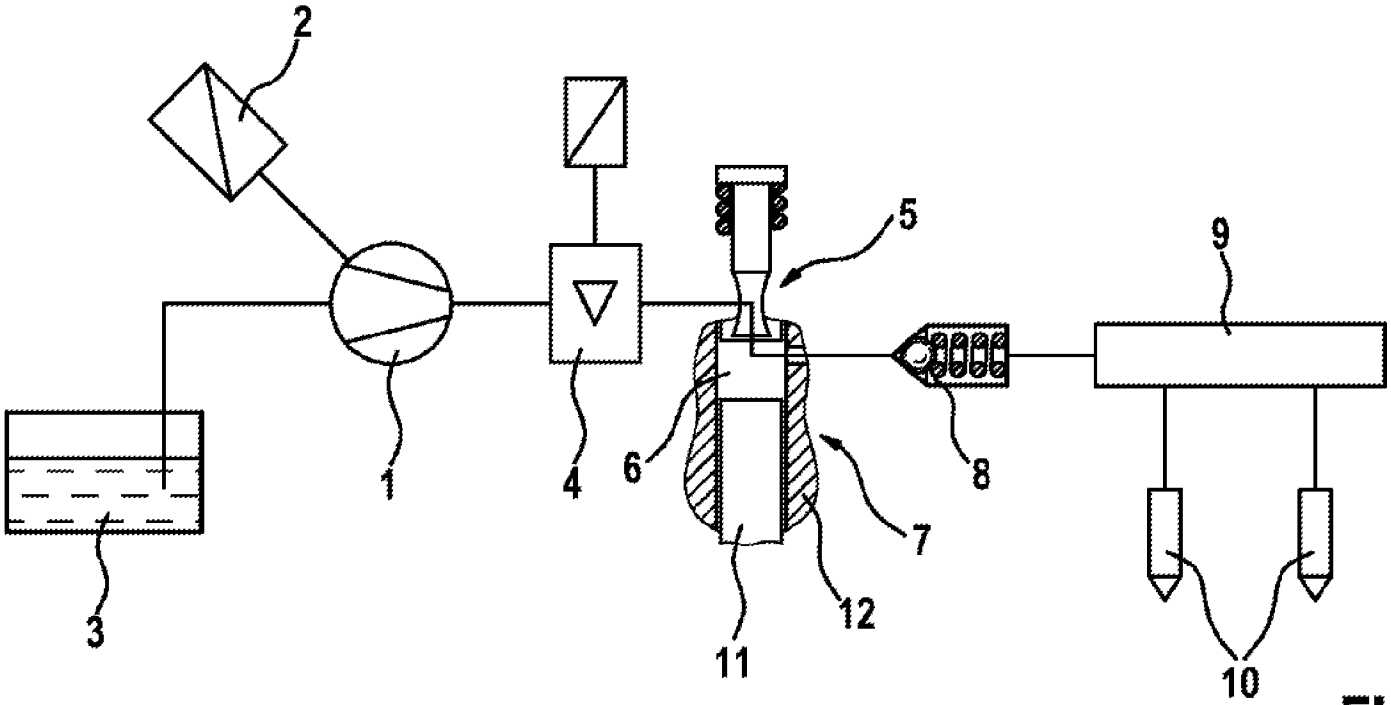
FIG. 1 shows the circuit configuration of the fuel injection system according to the invention.

The fuel injection system as shown in FIG. 1 comprises a pre-supply pump 1 in the form of a gear pump. The pre-supply pump 1 is operated by an electric motor 2 and draws fuel, in particular diesel fuel, from a tank 3, optionally via an interposed filter device. The fuel pumped by the pre-supply pump 1 is supplied via a normally electrically operated metering unit 4 and a suction valve 5 to the high-pressure working chamber 6 of a high-pressure pump 7. The high-pressure working chamber 6 is further connected via a nonreturn valve 8 to a high-pressure accumulator 9. The high-pressure accumulator 9 is in turn connected via high-pressure lines to fuel injectors 10 corresponding to the number of cylinder units of the internal combustion engine.

In normal operation the metering unit 4 controls the quantity of fuel supplied to the high-pressure pump 7 in dependence on the fuel pressure prevailing in the high-pressure accumulator 9. During the starting operation mode, the metering unit 4 is switched so that its control orifice is open and the entire quantity of fuel pumped by the pre-supply pump 1 is therefore fed to the high-pressure pump 7. The suction valve 5 is configured in such a way that during pumping operation of the high-pressure pump the fuel present in the high-pressure working chamber 6 cannot re-enter the line to the metering unit 4. The high-pressure pump has one or more pump pistons 11, which is/are moved back and forth in one or more pump cylinders 12 and pump/s the fuel introduced into the high-pressure pump working chamber 6 during a suction stroke via the nonreturn valve 8 into the high-pressure accumulator 9.

According to the invention, in the starting operating mode the pre-supply pump 1 in the form of a gear pump is operated at higher electrical power than in a normal pre-supply operating mode and for a short period pumps the fuel at a pressure of up to 120 bar into the high-pressure accumulator 9. This pressure is sufficient to allow reliable injection of fuel into the working chambers of the internal combustion engine via the fuel injectors 10.

Figure 2:
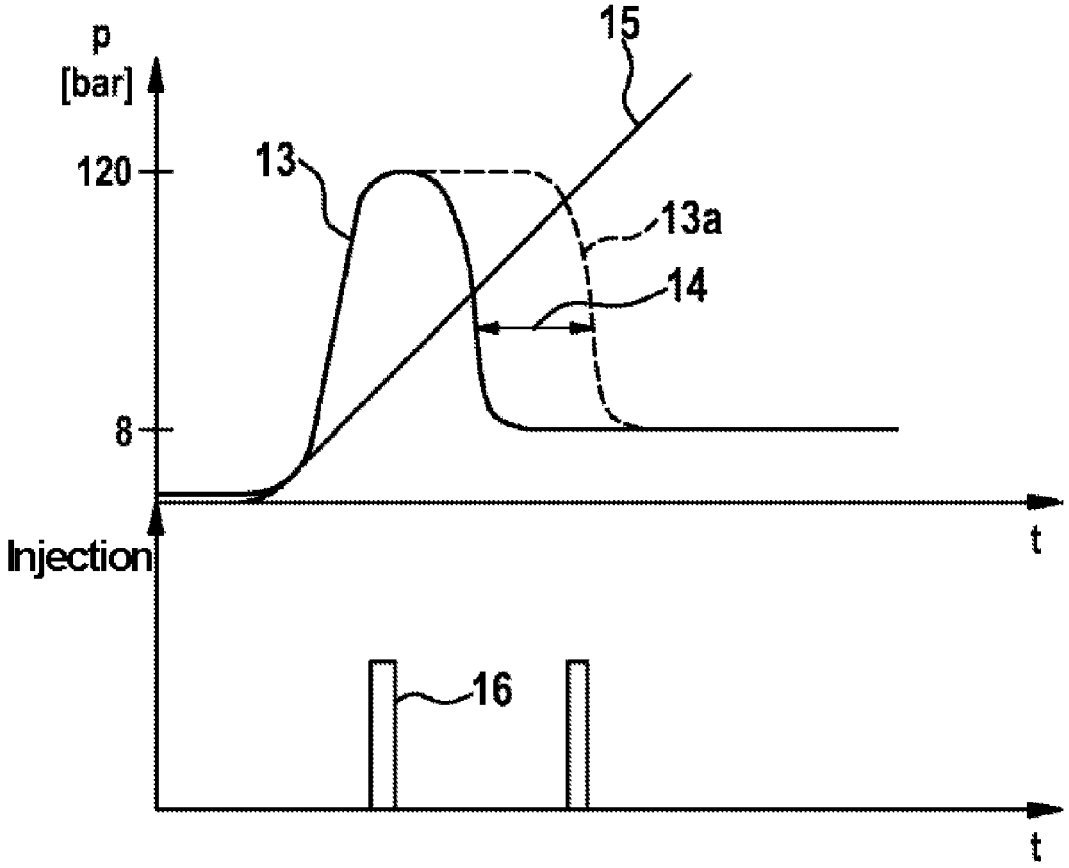
FIG. 2 is a graph representing the pressure control of the fuel injection system.

In the two-part diagram shown in FIG. 2 the fuel pressure generated by the fuel injection system is plotted over the time axis in the upper part, and an injection effected by the fuel injectors is plotted, also over the time axis, in the lower part. The parabolic curve 13 represents the delivery pressure which can be generated with the pre-supply pump 1 in the starting operating mode, a delivery pressure of 80-120 bar being reached in the region of the vertex of the parabola. Starting from the parabolic curve 13, the delivery pressure can be controlled in a regulated area 14 in such a way that the delivery pressure can be maintained at the level of 120 bar over a corresponding time, and is then restored to the pre-supply pressure in the range of 1-8 bar as shown by the broken-line curve 13*a*. At the same time, the diagram shows the pressure rise 15 generated by the high-pressure pump 7, which is generated after the internal combustion engine has been started. In the bottom part of the diagram the injection effected concurrently by the fuel injectors 10 is represented. Here, the first injection 16 triggered by a control unit which controls the entire system occurs at a time when a delivery pressure of 120 bar is reached by the pre-supply pump 1 in accordance with the parabolic curve 13.

The invention claimed is:

1. A fuel injection system of an internal combustion engine, comprising a pre-supply pump (1), a suction valve (5), and a downstream high-pressure pump (7) which is connected to a high-pressure accumulator (9) and the high-pressure accumulator (9) is operatively connected to at least one fuel injector (10), characterized in that the fuel injection system further comprises a fuel metering device (4) between the pre-supply pump (1) and the high pressure pump (7), wherein the pre-supply pump (1) is designed to generate a delivery pressure at which a fuel injection is effected by means of the fuel injector (10), at least in a defined operating state of the internal combustion engine, and wherein the pre-supply pump (1) supplies fuel through the fuel metering device (4) and to the high-pressure pump (7) via the suction valve (5).

2. The fuel injection system as claimed in claim 1, characterized in that the defined operating state is a starting process of the internal combustion engine.

3. The fuel injection system as claimed in claim 1, characterized in that the pre-supply pump (1) generates a delivery pressure of up to 120 bar.

4. The fuel injection system as claimed in claim 1, characterized in that the pre-supply pump (1) is a gear pump.

5. The fuel injection system as claimed in claim 1, characterized in that the pre-supply pump (1) is operated electrically.

6. The fuel injection system as claimed in claim 1, characterized in that a high-pressure pump working chamber (6) of the high-pressure pump (7) is connected to the suction valve (5) and to a nonreturn valve (8).

7. The fuel injection system as claimed in claim 1, characterized in that the pre-supply pump (1) can be operated in a starting operating mode and in a pre-supply operating mode.

8. The fuel injection system as claimed in claim 7, characterized in that the pre-supply pump (1) can be operated in the pre-supply operating mode after the internal combustion engine has been started.

9. A method for operating a fuel injection system of an internal combustion engine comprising a pre-supply pump (1), a suction valve (5), and a downstream high-pressure pump (7) which is connected to a high-pressure accumulator (9) which is operatively connected to a fuel injector (10), characterized in that the fuel injection system further comprises a fuel metering device (4) between the pre-supply pump (1) and the high pressure pump (7), wherein the pre-supply pump (1) is operated in a starting operating mode until the internal combustion engine has been started, in that during the starting operating mode a fuel injection is effected by the fuel injector (10) at the delivery pressure generated by the pre-supply pump (1) and in that the pre-supply pump (1) is operated in a pre-supply operating mode after the internal combustion engine has been started, and wherein, in both the starting operating mode and the pre-supply operating mode, the pre-supply pump supplies fuel through the fuel metering device (4) and to the high pressure pump (7) via the suction valve (5).

10. The method as claimed in claim 9, characterized in that the pre-supply pump (1) can be operated in the starting operating mode in such a way that the delivery pressure of the pre-supply pump (1) corresponds to a minimum opening pressure of the fuel injector (10).

11. The method as claimed in claim 9, characterized in that the pre-supply pump (1) can be adjusted to a delivery pressure of up to 120 bar in the starting operating mode and to a delivery pressure of up to 8 bar in the pre-supply operating mode.

12. The fuel injection system of claim 1, wherein, in a starting operating mode, the fuel metering device (4) is operable to switch such that a control orifice of the fuel metering device (4) is open and an entire quantity of the fuel pumped by the pre-supply pump (1) is fed to the high-pressure pump (7), and wherein, in a normal operation mode, the fuel metering device (4) is operable to control a quantity of fuel supplied to the high-pressure pump (7) in dependence on the fuel pressure prevailing in the high-pressure accumulator (9).

13. The method of claim 9, wherein, in the starting operating mode, the fuel metering device (4) is switched such that a control orifice of the fuel metering device (4) is open and an entire quantity of the fuel pumped by the pre-supply pump (1) is fed to the high-pressure pump (7), and wherein, in a normal operation mode, the fuel metering device (4) controls a quantity of fuel supplied to the high-pressure pump (7) in dependence on the fuel pressure prevailing in the high-pressure accumulator (9).

* * * * *